US006010383A

United States Patent [19]

Knall

[11] Patent Number: 6,010,383

[45] Date of Patent: Jan. 4, 2000

[54] PROTECTION OF ELECTRON-EMISSIVE ELEMENTS PRIOR TO REMOVING EXCESS EMITTER MATERIAL DURING FABRICATION OF ELECTRON-EMITTING DEVICE

[75] Inventor: N. Johan Knall, Sunnyvale, Calif.

[73] Assignee: Candescent Technologies Corporation, San Jose, Calif.

[21] Appl. No.: 08/962,525

[22] Filed: Oct. 31, 1997

[51] Int. Cl.[7] ..... H01J 9/02

[52] U.S. Cl. ..... 445/24

[58] Field of Search ..... 445/24, 50; 313/309

[56] References Cited

U.S. PATENT DOCUMENTS

| | | | |
|---|---|---|---|
| 3,755,704 | 8/1973 | Spindt et al. | 313/309 |
| 5,164,632 | 11/1992 | Yoshida et al. | 313/309 |
| 5,199,917 | 4/1993 | MacDonald et al. | 445/24 |
| 5,462,467 | 10/1995 | Macaulay et al. | 445/50 |
| 5,509,840 | 4/1996 | Huang et al. | 445/24 |
| 5,559,389 | 9/1996 | Spindt et al. | 313/310 |
| 5,564,959 | 10/1996 | Spindt et al. | 445/24 |
| 5,628,661 | 5/1997 | Kim et al. | 445/24 |
| 5,631,518 | 5/1997 | Barker | 445/24 |
| 5,656,530 | 8/1997 | Leary | 438/639 |
| 5,693,235 | 12/1997 | Liu et al. | 445/24 |
| 5,710,483 | 1/1998 | Peng | 445/24 |
| 5,791,959 | 8/1998 | Bartha et al. | 445/24 |

FOREIGN PATENT DOCUMENTS

| | | |
|---|---|---|
| 0508737 A1 | 10/1992 | European Pat. Off. . |
| WO 93/18536 | 9/1993 | WIPO . |

OTHER PUBLICATIONS

Brodie et al, "Vacuum Microelectronics," *Advances in Electronics and Electron Physics*, vol. 83, 1992, pp. 1–106.

Betsui, "Fabrication and Characteristics of Si Field Emitter Arrays," *Tech. Dig. IVMC 91*, 1991, pp. 26–29.

Busta, "Vacuum microelectonics—1992," *J. Micromech. Microeng.*, vol. 2, 1992, pp. 43–74.

Huang, "200–nm Gated Field Emitters," *IEEE Electron Device Letters*, Mar. 1993, pp. 121–122.

*Primary Examiner*—Kenneth J. Ramsey

*Attorney, Agent, or Firm*—Skjerven, Morrill, MacPherson, Franklin & Friel LLP; Ronald J. Meetin

[57] ABSTRACT

In a partially finished electron-emitting device having electron-emissive elements (56A) formed at least partially with electrically non-insulating emitter material, electron-emissive element contamination that could result from passage of contaminant material through an excess layer (56B) of the emitter material is inhibited by forming a protective layer (58 or 70) over the excess emitter-material layer before performing additional processing operations on the electron-emitting device. Subsequent to these processing operations, material of the excess and protective layers overlying the electron-emissive elements is removed to expose the electron-emissive elements.

24 Claims, 7 Drawing Sheets

PROTECTION OF ELECTRON-EMISSIVE ELEMENTS PRIOR TO REMOVING EXCESS EMITTER MATERIAL DURING FABRICATION OF ELECTRON-EMITTING DEVICE

CROSS-REFERENCE TO RELATED APPLICATION

This is related to Knall et al, U.S. patent application Ser. No. 08/904,967, filed Jul. 30, 1997. The contents of Knall et al are incorporated by reference to the extent not repeated herein.

FIELD OF USE

This invention relates to the fabrication of electron-emitting devices, especially electron emitters employed in flat-panel cathode-ray tube ("CRT") displays of the field-emission type.

BACKGROUND ART

A field-emission cathode (or field emitter) contains a group of electron-emissive elements that emit electrons upon being subjected to an electric field of sufficient strength. The electron-emissive elements are typically situated over a patterned layer of emitter electrodes. In a gated field emitter, a patterned gate layer typically overlies the patterned emitter layer at the locations of the electron-emissive elements. Each electron-emissive element is exposed through an opening in the gate layer. When a suitable voltage is applied between a selected portion of the gate layer and a selected portion of the emitter layer, the gate layer extracts electrons from the electron-emissive elements at the intersection of the two selected portions.

The electron-emissive elements are often shaped as cones. Referring to the drawings, FIGS. 1*a*–1*d* illustrate a conventional technique as, for example, disclosed in Spindt et al, U.S. Pat. No. 5,559,389, for creating conical electron-emissive elements in a gated field emitter for a flat-panel CRT display. At the stage shown in FIG. 1*a,* the partially finished field emitter consists of substrate 20, emitter-electrode layer 22, dielectric layer 24, and gate layer 26. Gate openings 28 extend through gate layer 26. Corresponding dielectric openings 30 extend through dielectric layer 24.

Using a grazing-angle deposition procedure, lift-off layer 32 is formed on top of gate layer 26 as depicted in FIG. 1*b.* Emitter material is deposited on top of the structure and into dielectric openings 30 in such a way that the apertures through which the emitter material enters openings 30 progressively close. Generally conical electron-emissive elements 34A are thereby formed in composite openings 28/30. See FIG. 1*c.* Layer 34B of excess emitter material simultaneously forms on top of gate layer 26. Lift-off layer 32 is subsequently removed to lift off excess emitter-material layer 34B. FIG. 1*d* shows the resultant structure.

At the stage shown in FIG. 1*c,* excess emitter-material layer 34B provides a barrier between electron-emissive cones 34A and the external environment. The presence of the barrier provides an opportunity to perform additional processing on the partially finished field emitter while excess layer 34B prevents cones 34A from being contaminated by materials that come into contact with the field emitter during the additional processing. However, the benefit provided by the barrier is reduced if excess layer 34B is porous to any of these materials. Accordingly, it is desirable to inhibit such materials from passing through excess emitter material, such as layer 34B, and contaminating cones 34A.

Also, the use of lift-off layer 32 to remove excess emitter-material layer 34B can be cumbersome. For example, the deposition of lift-off layer 32 must be performed carefully to assure that no lift-off material accumulates on emitter-electrode layer 22 and causes electron-emissive cones 34A to be lifted off during the lift-off of excess layer 34B.

Wilshaw, PCT Patent Publication WO 96/06443, utilizes an electrochemical technique for removing excess molybdenum that accumulates over a gate layer during deposition of molybdenum through openings in the gate layer to form conical portions of the electron-emissive elements of a field emitter. No lift-off layer is employed in Wilshaw's electrochemical removal technique. Should it be beneficial to perform additional processing on a partially finished field-emitter while excess emitter material overlies electron-emissive elements, it is desirable that materials employed during the additional processing be inhibited from contaminating the electron-emissive elements regardless of whether the excess emitter material is removed by a lift-off or electrochemical technique.

GENERAL DISCLOSURE OF THE INVENTION

In fabricating an electron-emitting device according to the invention, a layer of protective material is provided over a layer of excess emitter material subsequent to forming electron-emissive elements from the emitter material. Before removing excess emitter material overlying the electron-emissive elements and also before removing the protective material overlying the excess emitter material above the electron-emissive elements, additional processing is performed on the partially finished device.

The protective layer is normally largely impervious to materials which the partially finished device is subjected to during the additional processing. Accordingly, the protective layer largely prevents any of these materials from passing through the excess emitter material and contaminating the electron-emissive elements. When the combination of the excess emitter material and the other components of the device surrounds the electron-emissive elements, the electron-emissive elements are protected from damage during the additional processing even though the excess emitter material may be porous to the materials that come into contact with the partially finished field emitter during the additional processing.

The excess emitter material is typically removed in two stages. In the first stage, the excess emitter material is removed at locations spaced laterally apart from the electron-emissive elements. The excess emitter material overlying the electron-emissive elements is removed in the second stage. The protective layer can be formed over the excess emitter material before both removal stages or at a point between the two removal stages. In the latter case, part of the original protective material typically forms part of the final electron-emitting device.

In short, the invention enables the electron-emissive elements to be protected from contamination without significantly limiting process flexibility. The invention thus provides a significant advance.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

Figure 1A:
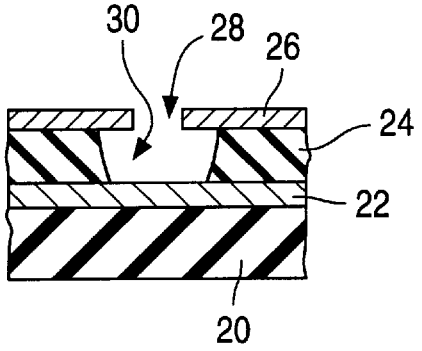
Fig. 1a PRIOR ART
FIGS. 1*a*–1*d* are cross-sectional structural views representing steps in a prior art process for manufacturing an electron emitter.
Figure 1B:
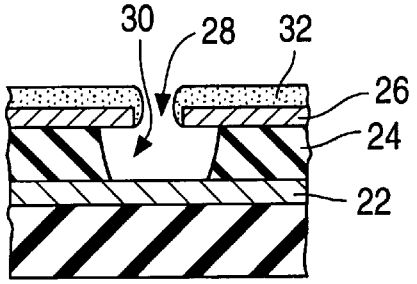
Fig. 1b PRIOR ART
Figure 1C:
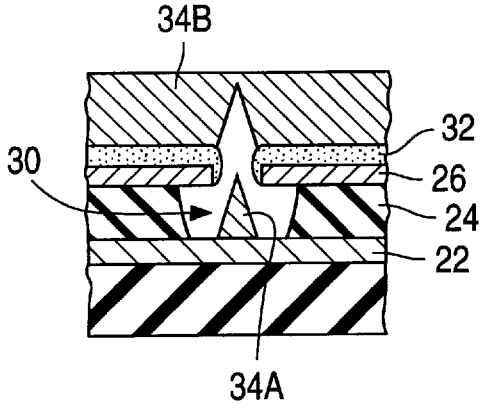
Fig. 1c PRIOR ART
Figure 1D:
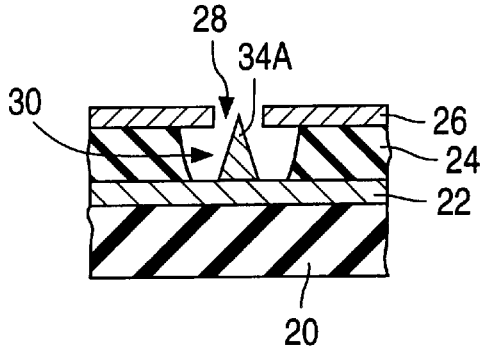
Fig. 1d PRIOR ART

The present invention furnishes processes for manufacturing a gated field-emission cathode in such a way that at least part of an electron focusing system is created while a protective layer covers a layer of excess emitter material to prevent materials used in creating the focusing system from contaminating electron-emissive elements formed from the emitter material. The field emitter is suitable for exciting phosphor regions on a faceplate in a cathode-ray tube of a flat-panel display such as a flat-panel television or a flat-panel video monitor for a personal computer, a lap-top computer, or a workstation.

In the following description, the term "electrically insulating" or "dielectric" generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. Similarly, the term "electrically non-conductive" refers to materials having a resistivity of at least 1 ohm-cm, and includes electrically resistive and electrically insulating materials. These categories are determined at an electric field of no more than 1 volt/$\mu$m.

FIGS. 2*a*–2*g* (collectively "FIG. 2") illustrate a process for manufacturing a gated field emitter of a flat-panel CRT display in accordance with the invention using a two-stage procedure for removing excess emitter material. In the fabrication process of FIG. 2, a protective layer is formed over the excess emitter material before the first stage of the removal procedure. FIGS. 3*a*–3*d* present layout views of the field emitter at the respective fabrication stages shown in FIGS. 2*b* and 2*e*–2*g*.

The starting point in the process of FIG. 2 is a flat electrically insulating baseplate (or substrate) 40. See FIG. 2*a*. Baseplate 40, which provides support for the field emitter, typically consists of glass, such as Schott D263 glass, having a thickness of approximately 1 mm.

A lower electrically non-insulating emitter region 42 overlies baseplate 40. Lower non-insulating region 42 contains an electrically conductive layer patterned into a group of laterally separated emitter electrodes. Letting the direction of the rows of picture elements (pixels) in the flat-panel CRT display be referred to as the row direction, the emitter electrodes of region 42 extend generally parallel to one another in the row direction so as to constitute row electrodes. The emitter electrodes typically consist of metal such as an alloy of aluminum or nickel. The thickness of the emitter electrodes is 0.1–0.5 $\mu$m, typically 0.2 $\mu$m.

An electrically resistive layer typically overlies the emitter electrodes in lower non-insulating region 42. Candidate materials for the resistive layer include cermet (ceramic with embedded metal particles) and silicon-carbon-nitrogen compounds, including silicon carbide. The resistive layer provides a resistance of $10^6$–$10^{10}$ ohms, typically $10^9$ ohms, between each electron-emissive element and the underlying emitter electrode.

An electrically insulating layer 44, which serves as the interelectrode dielectric, is provided on top of non-insulating region 42. The thickness of dielectric layer 44 is 0.05–3 $\mu$m, typically 0.15 $\mu$m. Dielectric layer 44 typically consists of silicon oxide or silicon nitride. Although not shown in FIG. 2*a*, parts of dielectric layer 44 may contact baseplate 40 depending on the configuration of non-insulating region 42.

Figure 2A:
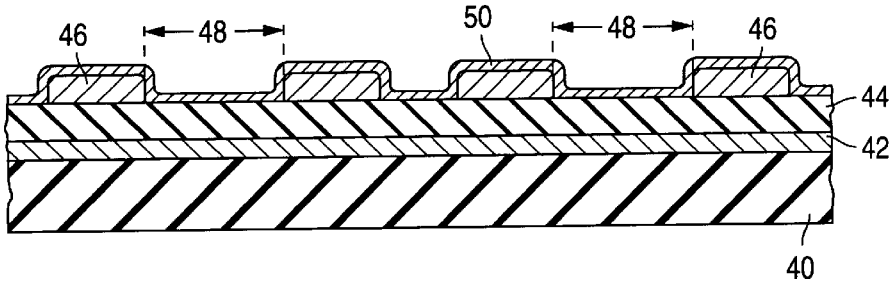
FIGS. 2*a*–2*g* are cross-sectional structural views representing steps in manufacturing a gated field emitter according to the invention.

A group of laterally separated main control electrodes 46 are situated on top of dielectric layer 44. Control electrodes 46 extend generally perpendicular to the emitter electrodes of lower non-insulating region 42. That is, control electrodes 46 extend in the direction of the columns of pixels so as to constitute main column electrodes. Two control electrodes 46 are depicted in FIG. 2*a*. Electrodes 46 normally consist of metal, typically chromium having a thickness of 0.1–0.5 $\mu$m, typically 0.2 $\mu$m. Alternative metals for electrodes 46 are aluminum, nickel, tantalum, and tungsten.

A group of laterally separated main control apertures 48 extend through each main control electrode 46 down to dielectric layer 44. Main control apertures 48 in each electrode 46 respectively overlie the emitter electrodes of non-insulating region 42. Accordingly, control apertures 48 form a two-dimensional array of rows and columns of control apertures. One control aperture 48 is depicted in FIG. 2*a* for each control electrode 46.

A blanket electrically non-insulating gate layer 50 is situated on top of the structure in FIG. 2*a*. Specifically, gate layer 50 overlies control electrodes 46 and extends into control apertures 48 down to dielectric layer 44. Gate layer 50 also extends down to dielectric layer 44 in the spaces between control electrodes 46. Gate layer 50 normally consists of metal, typically chromium having a thickness of 0.02–0.08 $\mu$m, typically 0.04 $\mu$m. Alternative metals for layer 50 are tantalum, gold, and tungsten.

Figure 2B:
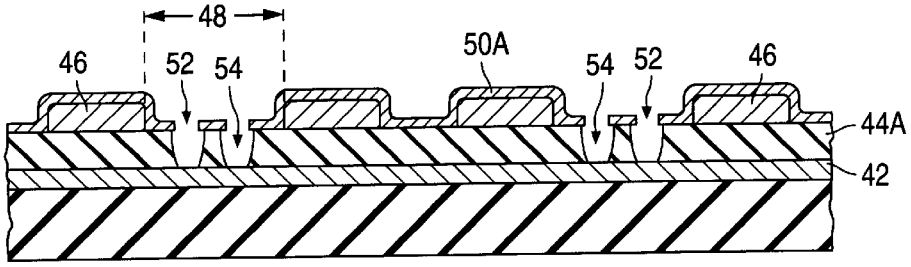

Gate openings 52 are created through gate layer 50 down to dielectric layer 44 within control apertures 48 as shown in FIG. 2*b*. Item 50A in FIG. 2*b* is the remainder of gate layer 50. Gate openings 52 are typically created according to a charged-particle tracking procedure of the type described in U.S. Pat. No. 5,559,389 or 5,564,959. Openings 52 can also be created according to a sphere-based technique of the type described in Haven et al, U.S. patent application Ser. No. 08/660,536, filed Jun. 7, 1996, or Ludwig et al, U.S. patent application Ser. No. 08/660,538, also filed Jun. 7, 1996, now U.S. Pat. No. 5,865,659.

Figure 3A:
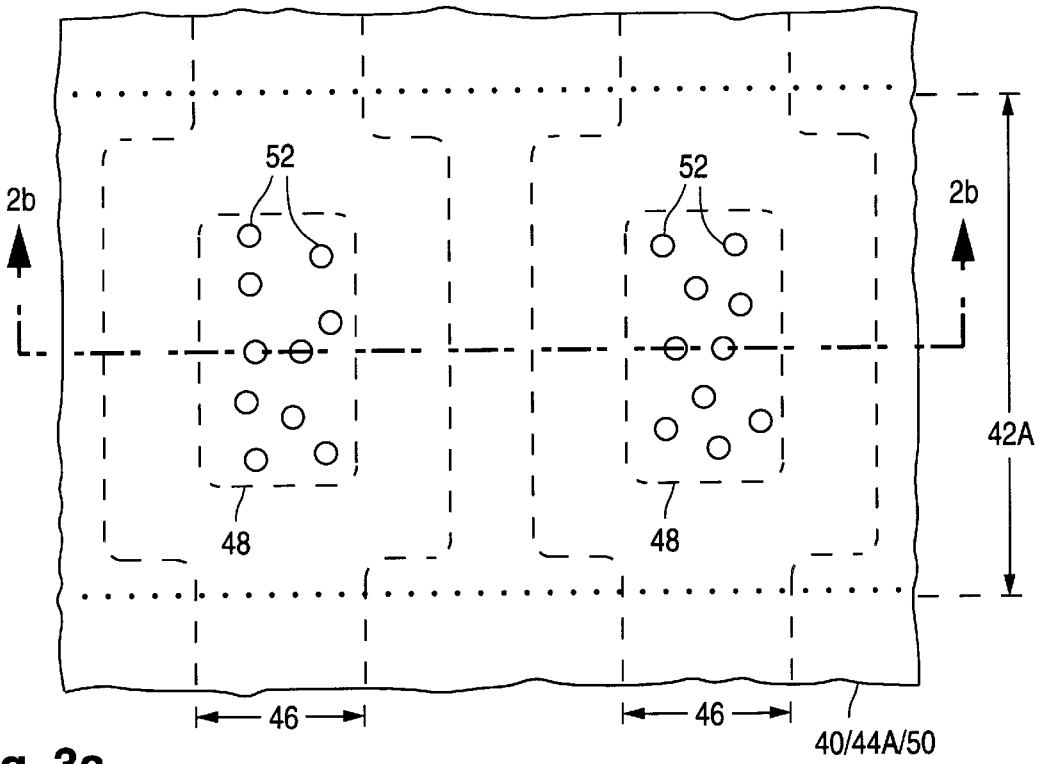
FIGS. 3*a*–3*d* are layout view of the respective structures in FIGS. 2*b* and 2*e*–2*g*. The cross section of FIG. 2*b* is taken through plane 2*b*—2*b* in FIG. 3*a*. The cross sections of FIGS. 2*e*–2*g* are similarly respectively taken through planes 2*e*—2*e*, 2*f*—2*f*, and 2*g*—2*g* in FIGS. 3*b*–3*d*.

The portion of remaining gate layer 50A at the bottom of each control aperture 48 contains multiple gate openings 52. The combination of a control aperture 48 and the particular gate openings 52 extending through the portion of gate layer 50A spanning that aperture 48 form a composite control aperture 48/52. Since control apertures 48 are arranged in a two-dimensional row/column array, gate openings 52 are arranged in a two-dimensional array of rows and columns of sets of multiple gate openings. See FIG. 3*a* in which two of the sets of gate openings 52 are depicted. Item 42A in FIG. 3*a* represents one of the emitter electrodes of non-insulating region 42. As indicated in FIG. 3*a*, each control electrode 46 is wider over emitter electrodes 42A than in the spaces between electrodes 42A.

Using gate layer 50A as an etch mask, dielectric layer 44 is etched through gate openings 52 to form dielectric openings 54 down to non-insulating region 42. Item 44A in FIG. 2*b* is the remainder of dielectric layer 44. The etch to create dielectric openings 54 is normally performed in such a manner that openings 54 undercut gate layer 50A somewhat. Each dielectric opening 54 and the overlying gate opening 52 form a composite opening 52/54.

Figure 2C:
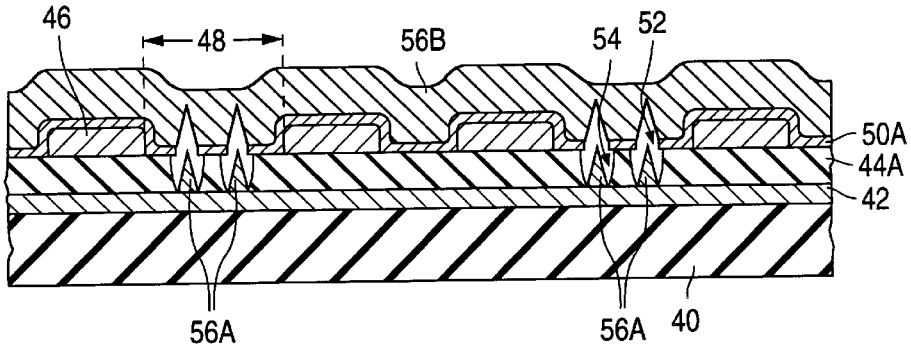

Referring to FIG. 2*c*, electrically non-insulating emitter cone material is evaporatively deposited on top of the structure in a direction generally perpendicular to the upper (or lower) surface of baseplate 40. The emitter cone material accumulates on the exposed portions of gate layer 50A and passes through gate openings 52 to accumulate on lower non-insulating region 42 in dielectric openings 54. Due to the accumulation of the emitter cone material on gate layer 50A, the openings through which the emitter material enters openings 54 progressively close. The deposition is performed until these openings fully close. As a result, the emitter material accumulates in dielectric openings 54 to form corresponding conical electron-emissive elements 56A. A continuous (blanket) excess layer 56B of the emitter material simultaneously accumulates on gate layer 50A.

The emitter cone material is normally metal, preferably molybdenum when gate layer 50 consists of chromium. Evaporatively deposited molybdenum, while providing excellent electron-emission characteristics, is porous to certain of the materials later used in forming part of an electron focusing system during the period when excess emitter cone material overlies electron-emissive cones 56A. Alternative candidates for the evaporatively deposited emitter material include nickel, chromium, platinum, niobium, tantalum, titanium, tungsten, titanium-tungsten, and titanium carbide subject to the emitter material differing from the gate material when an electrochemical technique is later employed to remove one or more portions of excess emitter-material layer 56B.

Figure 2D:
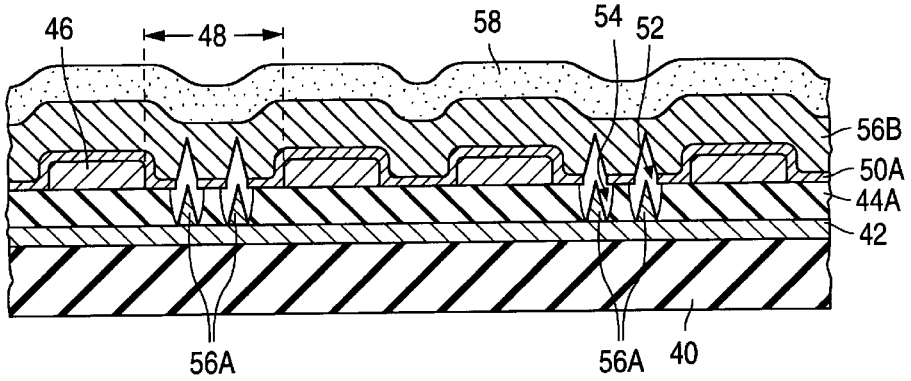

A blanket protective layer 58 is deposited on excess emitter-material layer 56B as shown in FIG. 2*d*. Protective layer 58 is of such type and thickness as to be largely impervious to the materials utilized in providing the field emitter with features, such as part or all of the electron focusing system, during the period in which excess emitter material overlies cones 56A. As indicated below, substantially all of protective layer 58 is eventually removed from the field emitter. Accordingly, layer 58 can be formed with electrically insulating material and/or electrically non-insulating material. The protective material of layer 58 typically consists of silicon oxide having a thickness of 0.05–0.6 $\mu$m, typically 0.1 $\mu$m. Other candidates for the protective material include silicon nitride, nickel, copper, and sputter deposited molybdenum.

A photoresist mask (not shown) is formed on protective layer 58. The photoresist mask has solid masking portions which are situated fully above control apertures 48 and which extend partially above adjoining portions of main control electrodes 46. Preferably, each solid masking portion is generally in the shape of a rectangle that overlies a corresponding one of control apertures 48 and is laterally separated from masking portions that overlie the other control apertures 48 in the same control electrode 46.

The material of protective layer 58 exposed through the photoresist mask is removed with a suitable etchant. The resultant exposed material of excess layer 56B is similarly removed with a suitable etchant. Although the photoresist mask can be removed before etching excess layer 56B, the photoresist is normally left in place during the etch of layer 56B.

More particularly, the portions of the protective and excess emitter materials occupying the spaces between control electrodes 46 are removed down to gate layer 58. Also, the portions of the protective and excess emitter materials (a) lying over the longitudinal edges of electrodes 46 and (b) situated between control apertures 48 are normally removed down to layer 50A along with one or more portions of the protective and excess emitter materials situated in the lateral periphery of the field emitter—i.e., outside the active image area. See FIGS. 2*e* and 3*b* in which items 56C and 58A respectively indicate the remainders of layers 56B and 58.

Excess emitter-material remainder 56C consists of a two-dimensional array of rows and columns of generally rectangular islands that respectively extend fully across, and thus fully occupy, control apertures 48. Each of excess emitter-material islands 56C is covered by a corresponding generally rectangular island of protective-material remainder 58A. Each protective island 58A and the underlying excess emitter-material island 56C form a composite island 56C/58A.

The etchant utilized to etch protective layer 58 can be a largely anistropic etchant (e.g., a plasma) or an etchant (e.g., a liquid chemical) having a substantial isotropic component. In the latter case, protective-material islands 58A undercut the photoresist mask. When protective layer 58 consists of silicon oxide, layer 58 is typically etched for 40 sec. at room temperature with a chemical etchant consisting of 50% acetic acid, 30% water, and 20% ammonium fluoride by weight to form protective islands 58A. The photoresist mask is therefore slightly undercut.

The etchant employed to etch excess emitter-material layer 56B is typically a liquid chemical etchant and has a substantial isotropic component. Consequently, excess emitter-material islands 56C undercut the photoresist mask slightly more. When excess layer 56B consists of molybdenum, the exposed molybdenum is typically removed with a chemical etchant consisting of 16 parts phosphoric acid, 1 part acetic acid, 1 part nitric acid, and 2 parts water. The etch is conducted for 40–300 sec., typically 90 sec., at 15–50° C., typically 40° C.

Figure 2E:
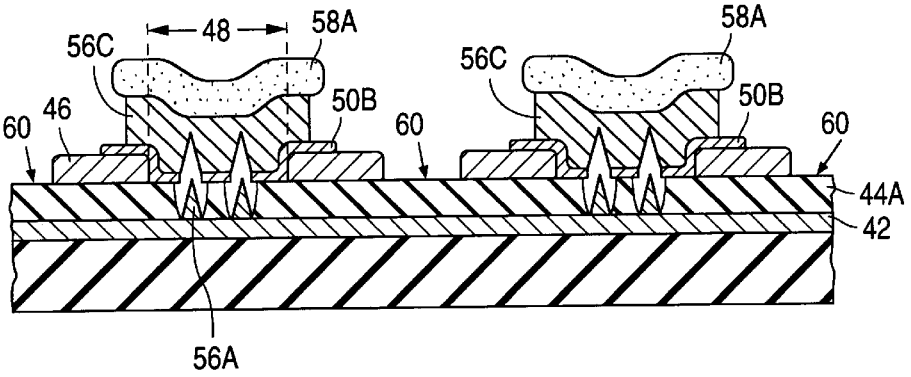
Figure 3B:
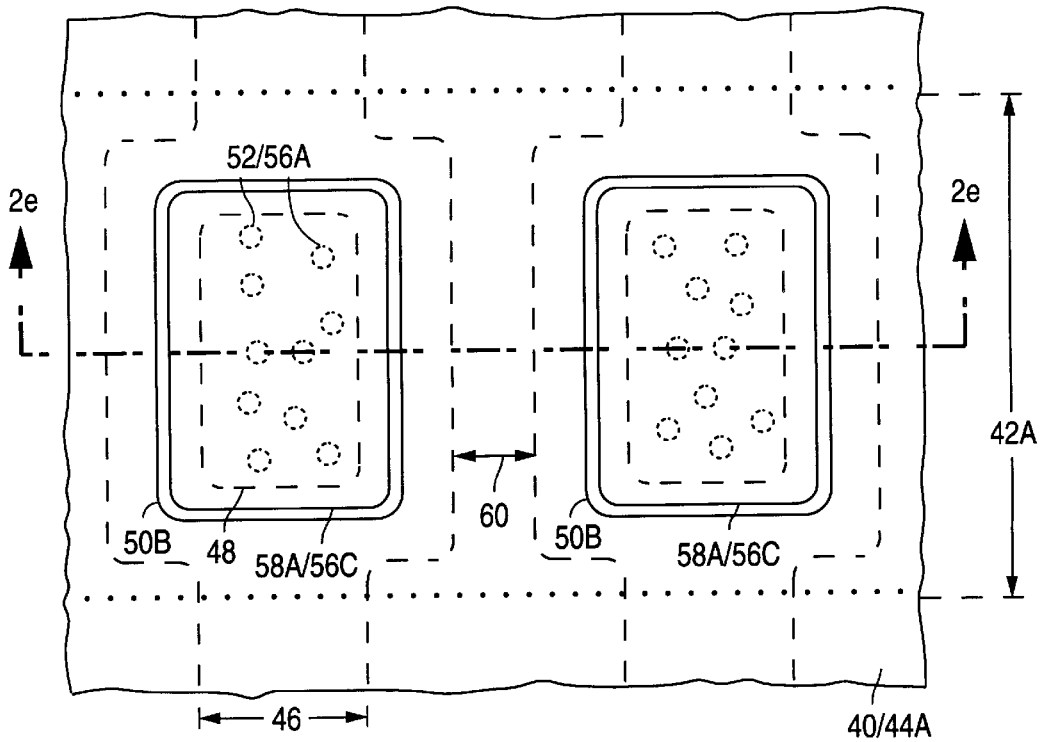
Figure 3C:
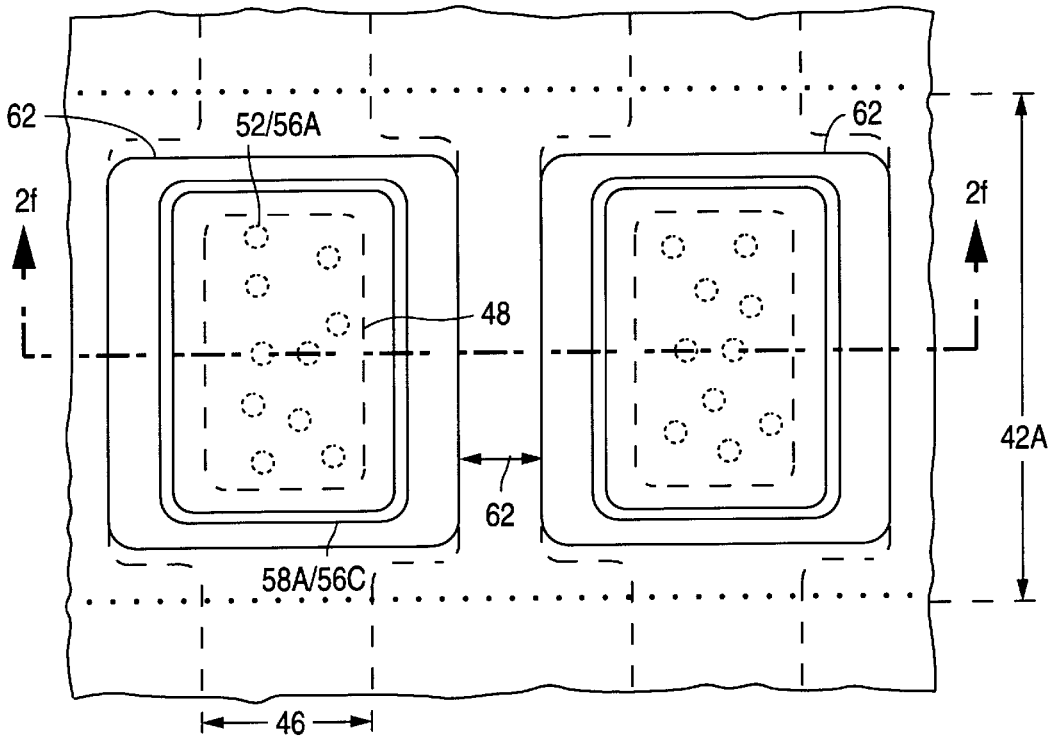

With the photoresist mask still in place, blanket gate layer 50A is selectively etched to produce patterned gate layer 50B. The gate etch is usually performed with a largely anisotropic etchant, typically a chlorine plasma, in a direction generally perpendicular to the upper surface of baseplate 40 so that gate layer 50B does not significantly undercut the photoresist mask. FIGS. 2*e* and 3*b* depict the resultant structure after removing the photoresist. Since etchants with isotropic components were employed in selectively etching protective layer 58 and excess emitter-material layer 56B whereas a fully anisotropic etchant was utilized in selectively etching blanket gate layer 50A through the same photoresist mask, the resulting portions of gate layer 50B respectively extend laterally outward slightly beyond protective islands 58A and excess emitter-material islands 56C.

Alternatively, blanket gate layer 50A can be patterned with an etchant having a substantial isotropic component to reduce or substantially eliminate the lateral extension of gate portions 50B beyond excess emitter-material islands 56C.

The lateral extension of gate portions 50B beyond excess islands 56C can also be reduced or substantially eliminated by patterning protective layer 58 and excess layer 56B with largely anisotropic etchants. In any event, each main control electrode 46 and the adjoining gate portions 50B form a composite control electrode 46/50B extending in the column direction.

Also, insulating layer 44A is now exposed at areas 60. Various features can now be formed over areas 60 and other portions of the upper surface not covered by composite islands 56C/58A.

Figure 2F:
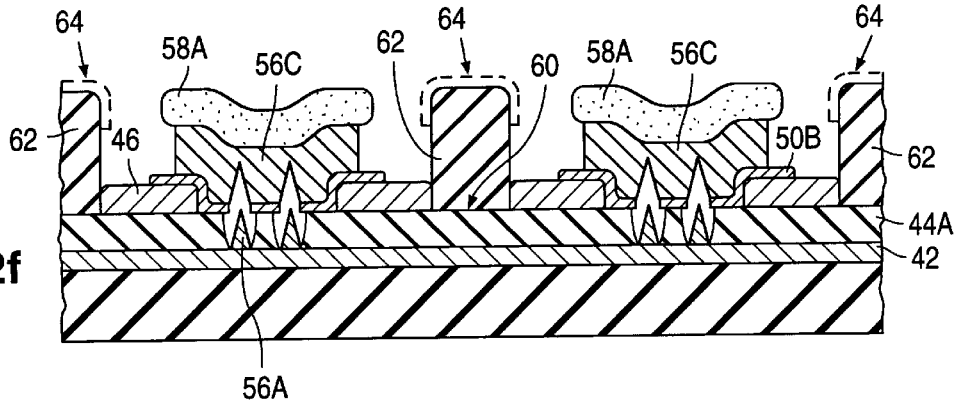

An electrically non-conductive base focusing structure 62 for a system that focuses electrons emitted by cones 56A is typically formed on top of the partially finished field emitter as shown in FIG. 2*f*. Base focusing structure 62 is generally arranged in a waffle-like pattern as viewed perpendicularly to the upper surface of baseplate 40. See FIG. 3*c*. In the row direction, portions of focusing structure 62 typically occupy the spaces above exposed areas 60 of dielectric layer 44A. In the column direction, focusing structure 62 typically passes over main control electrodes 46 outside control apertures 48. Consequently, apertures 48 are situated laterally within the boundaries of respective focus openings in structure 62.

Base focusing structure 62 normally consists of electrically insulating material but can be formed with electrically resistive material of sufficiently high resistivity so as to not cause main control electrodes 46 to be electrically coupled to one another. Typically, focusing structure 62 is formed with actinic material that has been selectively exposed to suitable actinic radiation, developed to remove either the unexposed actinic material or the unexposed actinic material, and cured. Exposure to the actinic radiation causes the exposed actinic material to change chemical structure. The actinic material is typically photopolymerizable polyimide such as Olin OCG7020 polyimide. Focusing structure 62 typically extends 45–50 $\mu$m above insulating layer 44A.

Various techniques can be employed to form base focusing structure 62. For instance, focusing structure 62 can be formed according to the backside/frontside actinic-radiation exposure procedure described in Haven, U.S. Pat. No. 5,649,847 or 5,650,690. Alternatively, structure 62 can be created according to the backside/frontside actinic-radiation procedure disclosed in Spindt et al, U.S. patent application Ser. No. 08/866,150, filed May 30, 1997. In this case, emitter electrodes 42A in non-insulating region 42 are typically in the shape of ladders as viewed perpendicularly to the upper surface of baseplate 40. Focusing structure 62 can also be formed according to a procedure that employs only frontside actinic-radiation exposure such as that described in Knall, co-filed U.S. patent application Ser. No. 08/962,527, now allowed.

In performing the additional processing that leads from the structure of FIG. 2*e* to the structure of FIG. 2*f*, each electron-emissive cone 56A is fully surrounded by portions of components 42, 44A, 50B, and 56C. Components 42, 44A, and 50B are normally largely impervious to any of the materials, such as polyimide and the developer/etching agent, employed in forming base focusing structure 62. Consequently, substantially none of these materials passes through any of components 42, 44A, and 50B to contaminate cones 56A.

Some of the materials employed in forming base focusing structure 62 typically can pass through evaporatively deposited molybdenum depending on its thickness and how long, and at what temperature, the molybdenum is exposed to the materials. In the absence of protective islands 58A, portions of these materials could pass through excess emitter-material islands 56C, especially at the thin regions directly above electron-emissive cones 56A, and contaminate cones 56A. Importantly, protective islands 58A are arranged to be largely impervious to these materials. In going from the structure of FIG. 2*e* to that of FIG. 2*f*, islands 58A largely prevent the materials utilized in forming focusing structure 62 from contacting excess islands 56C in the vertical direction and subsequently passing vertically through islands 56C.

Protective islands 58A do not cover the side edges of excess emitter-material islands 56C. Accordingly, the materials used in creating base focusing structure 62 typically come into contact with the side edges of excess islands 56C. However, islands 56C are configured to extend laterally far enough beyond control apertures 48 that lateral penetration of any of these materials through islands 56C so as to come in contact with electron-emissive cones 56A does not occur to any significant degree. The net result is that cones 56A are not contaminated by the materials used in forming structure 62. Protective islands 58A prevent any contamination that might otherwise occur.

The electron focusing system includes a thin electrically non-insulating focus coating 64 provided over base focusing structure 62. Focus coating 64 normally consists of electrically conductive material, typically a metal such as aluminum having a thickness of 0.1 $\mu$m. In certain applications, focus coating 64 can be formed with electrically resistive material. In any event, the resistivity of focus coating 64 is normally considerably less than that of base focusing structure 62.

Focus coating 64 can be formed at various points in the fabrication process. Coating 64 is typically created after protective layer 58A and excess emitter-material layer 56C are removed. However, coating 64 can be formed before removing layers 58A and 56C as indicated by the dashed lines used to indicate coating 64 in FIG. 2*f*. Depending on factors such as the height of base focusing structure 62 relative to the height of composite islands 56C/58A, segments (not shown) of the focus coating material may accumulate on the top and side surfaces of islands 56C/58A. If focus coating 64 is created before removing islands 58A and 56C, protective islands 58A prevent the materials employed in forming coating 64 from contaminating cones 56A in the same way that cones 56A are prevented from contamination during the formation of base focusing structure 62.

Focus coating 64 can be formed in various ways provided that it is appropriately electrically isolated from composite control electrodes 46/50B. For example, coating 64 can be formed by low-angle evaporative deposition as described in Haven et al, U.S. patent application Ser. No. 08/866,554, filed May 30, 1997. Coating 64 can also be created in the manner described in Knall, U.S. patent application Ser. No. 08/962,527, cited above.

With at least base focusing structure 62 of the electron focusing system having been formed, protective islands 58A and excess emitter-material islands 56C are removed. The removal of islands 58A and 56C can be performed in various ways. Excess islands 56C are typically removed electrochemically according to a technique of the type described in Knall et al, U.S. patent application Ser. No. 08/884,700, filed Jun. 30, 1997, now U.S. Pat. No. 5,893,967. Protective islands 58A can also be removed electrochemically during, or prior to, the electrochemical removal of excess islands 56C. Alternatively, protective islands 58A can be lifted off as excess islands 56C are removed electrochemically. Also, protective islands 58A can be removed with a suitable chemical and/or plasma etchant after which excess islands 56C are electrochemically removed.

As a further alternative, excess emitter-material islands 56C can be removed according to a lift-off technique. In this case, a lift-off layer is provided on top of gate layer 50A at the stage shown in FIG. 2*b*. The lift-off layer is typically created by evaporating a suitable lift-off material at a relatively small angle, typically in the vicinity of 30°, to the upper surface of baseplate 40. The lift-off material is subsequently patterned in largely the same way as excess emitter-material layer 56B.

At the stage shown in FIG. 2*f*, an island of the lift-off layer lies between each excess emitter-material island 56C and underlying gate portion 50B. A suitable etchant is employed to remove the lift-off islands. Excess islands 56C are thereby lifted off and carried away in the etchant.

When a lift-off technique is employed to remove excess emitter-material islands 56C, protective islands 58A can be removed at the same time as an attendant effect of removing excess islands 56C. Alternatively, protective islands 58A can be removed first with a suitable etchant so as to expose the entire upper surfaces of excess islands 56C. If islands 56C are porous to the etchant used in lifting them off, advantage can be taken of this porosity to let the lift-off etchant penetrate islands 56C vertically and rapidly attack the underlying lift-off islands along their entire upper surfaces. The lift-off operation is then performed in a relatively short time.

Figure 2G:
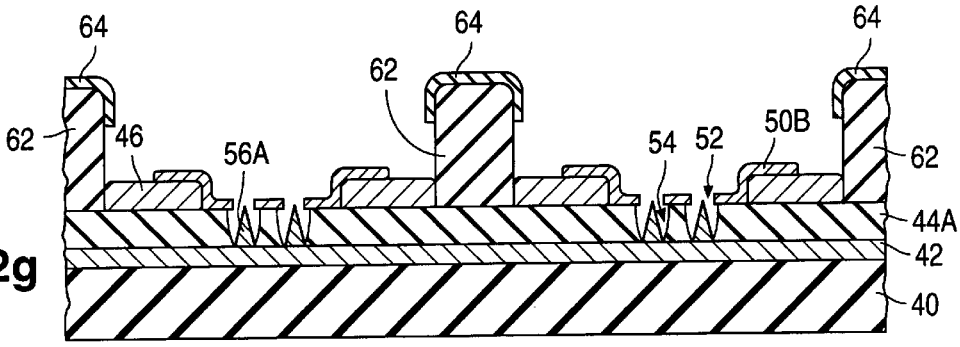
Figure 3D:
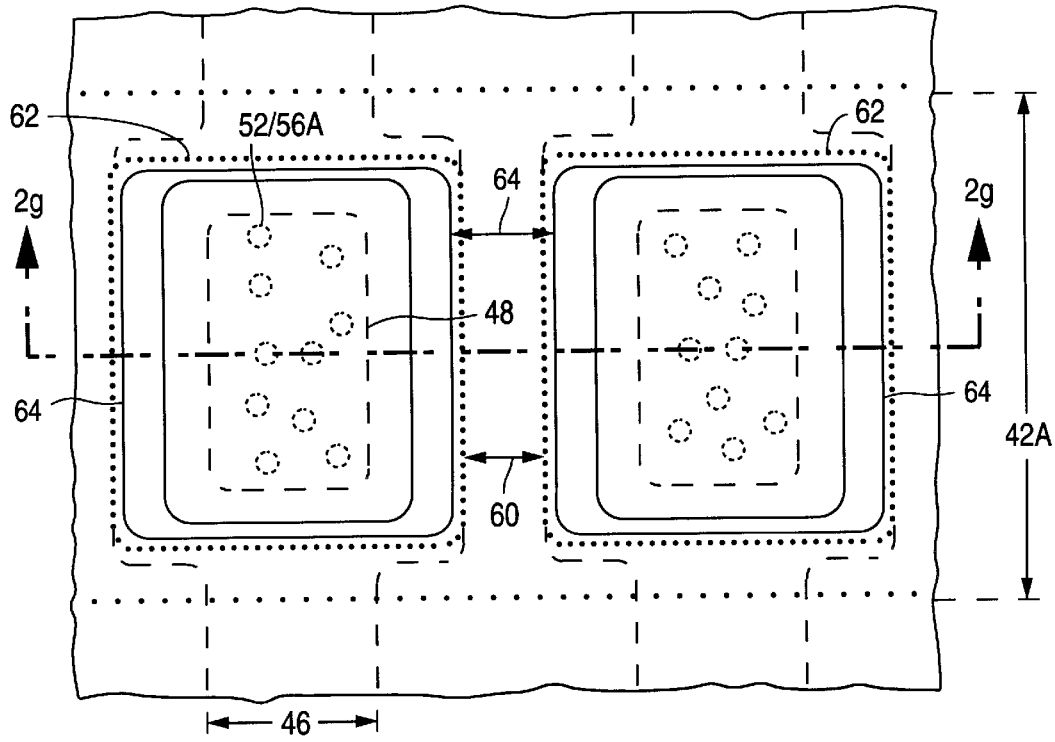

If focus coating 64 is not yet incorporated into the electron focusing structure, coating 64 is now formed over focusing structure 93. The resultant field-emission structure is shown in FIGS. 2*g* and 3*d*.

The flat-panel CRT display is typically a color display in which each pixel consists of three sub-pixels, one for red, another for green, and the third for blue. Typically, each pixel is approximately square as viewed perpendicularly to the upper surface of baseplate 40, the three sub-pixels being laid out as rectangles situated side by side in the row direction with the long axes of the rectangles oriented in the column direction. In this sub-pixel layout, electron focus control is normally more critical in the row direction than in the column direction.

The sets of electron-emissive elements 56A in each control aperture 48 provide electrons for one sub-pixel. The control apertures 48 in each composite control electrode 46/50B are arranged to be centered on that electrode 46/50B in the row direction. By arranging for edges of electron focusing system 62/64 to be approximately aligned vertically with the longitudinal edges of composite control electrodes 46/50B in the manner depicted in FIGS. 2*g* and 3*d*, excellent focus control is achieved in the row direction. Opening areas 60 during the selective etch of layers 58 and 56B to form composite islands 58A and 56C permits this vertical alignment to be attained and thus enables the desired focus control to be achieved.

When using a two-step procedure to remove excess emitter material, a protective layer can alternatively be formed on the excess emitter material overlying the electron-emissive elements at a point subsequent to the first removal stage rather than before the first removal stage (as occurs in the process of FIG. 2). FIGS. 4*a*–4*d* (collectively "FIG. 4") illustrate part of a process that employs this alternative in fabricating a gated field-emitter of a flat-panel CRT display in accordance with the invention. The process of FIG. 4 follows the process of FIG. 2 up through the stage of FIG. 2*c* in which the emitter cone material is deposited to form conical electron-emissive elements 56A and excess emitter-material layer 56B.

In the process of FIG. 4, a photoresist mask (not shown) typically having the same pattern as the photoresist mask utilized to pattern layers 58 and 56B in the process of FIG. 2 is formed on top of excess emitter-material layer 56B at the stage shown in FIG. 2*c*. The material of excess layer 56B exposed through the photoresist mask is removed with a suitable etchant that directly attacks the exposed emitter material. Except for the absence of a protective layer at this point in the process of FIG. 4, the selective etch to pattern excess layer 56B is performed in the way described above for the process of FIG. 2. The remainder of excess layer 56B again consists of islands 56C. The etchant is typically a chemical etchant and thus has a substantial isotropic component. Consequently, excess emitter-material islands 56C undercut the photoresist slightly. Gate layer 50A is now partially exposed.

With the photoresist mask overlying control apertures 48, gate layer 50A is patterned in largely the manner described above to form laterally separated gate portions 50B. The photoresist is removed to produce the structure shown in FIG. 4*a*. Gate portions 50B again respectively extend laterally outward slightly beyond excess islands 56C. Alternatively, layers 56B and 50A can be etched in such a manner that the edges of excess islands 56C and gate portions 50B are in substantial vertical alignment.

Figure 4A:
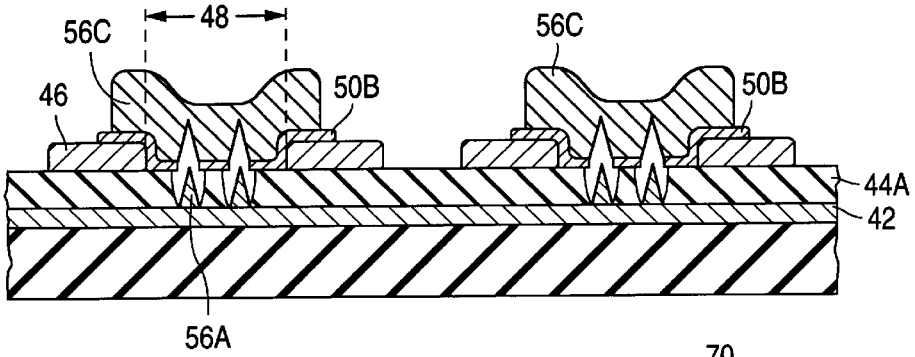
FIGS. 4*a*–4*d* are cross-sectional structure views representing steps substituted for the steps of FIGS. 2*d*–2*g* in manufacturing another gated field emitter according to the invention.
Figure 4B:
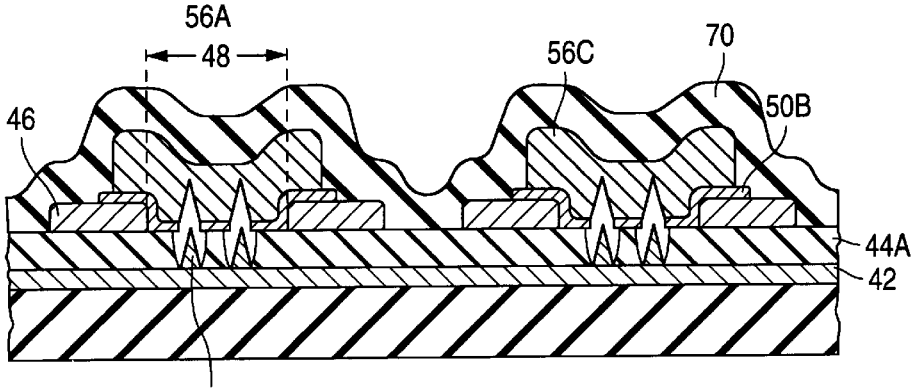
Figure 4C:
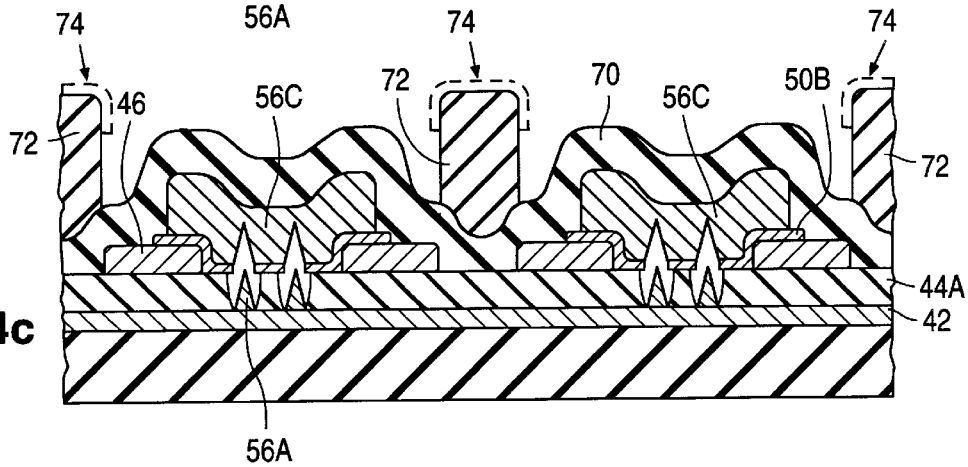

A protective layer 70 is formed on top of the structure as shown in FIG. 4*b*. In particular, protective layer 70 lies on the upper and side surfaces of excess islands 56C and extends laterally beyond islands 56C. Similar to protective layer 58, protective layer 70 is of such type and thickness as to be largely impervious to the materials used in creating features, such as part or all of an electron focusing system, during the period in which excess islands 56C overlie electron emissive cones 56A.

Portions of protective layer 70 are typically present in the final field emitter. Accordingly, the material and thickness of protective layer 70 are chosen to conform to the functions performed by adjacent components of the field-emitter. Layer 70 typically consists of electrically non-conductive material, normally electrically insulating material. When portions of layer 70 underlie (or form part of) a base focusing structure of the electron focusing system, layer 70 is typically formed with silicon oxide having a thickness of 0.05–1.0 $\mu$m, typically 0.5 $\mu$m. Alternative materials for layer 70 in such applications include silicon nitride and spin-on glass.

Various features can now be formed over protective layer 70. Typically, a base focusing structure 72 of an electron focusing system is formed on top of layer 70. See FIG. 4*c*. Base focusing structure 72 typically has largely the same waffle-like pattern as base focusing structure 62. Focusing structure 72 can be formed in any of the ways described above for focusing structure 62, provided that protective layer 70 has appropriate properties.

An electrically non-insulating focus coating 74 is subsequently formed over base focusing structure 72. Although focus coating 74 is typically created after excess emitter-material islands 56C are removed, coating 74 can be formed while islands 56C are in place. For this reason, coating 74 is indicated in dashed line in FIG. 4*c*. Coating 74 is typically created in the same way, and with the same material, as focus coating 62.

Using base focusing structure 72 and, when present, focus coating 74 as an etch mask, the exposed portions of protective layer 70 are removed with a suitable etchant. See FIG. 4*d* in which item 70A is the remainder of protective coating 70. Remaining protective layer 70A underlies focusing structure 72 and effectively forms part of the electron focusing system.

Protective layer 70 can be etched with a chemical or plasma etchant, depending on various factors, to define layer 70A. When focusing system 72/74 is formed as described in Knall, U.S. patent application Ser. No. 08/962,527, cited above, the etchant is typically formed with 50% acetic acid, 30% water, and 20% ammonium fluoride by weight.

Excess emitter-material islands 56C are subsequently removed. See FIG. 4*d*. The removal of excess islands 56C is typically performed electrochemically. Alternatively, islands 56C can be removed according to a lift-off technique. In the lift-off case, a lift-off layer is formed over gate layer 50 or 50A at the stage shown in FIG. 2*b*. The lift-off layer is subsequently patterned in largely the same way as excess emitter-material layer 56B. After etching protective layer 70 to define protective remainder 70A, the lift-off layer is removed in order to remove excess islands 56C. If not already formed, focus coating 74 is created to complete the structure shown in FIG. 4*d*.

Figure 4D:
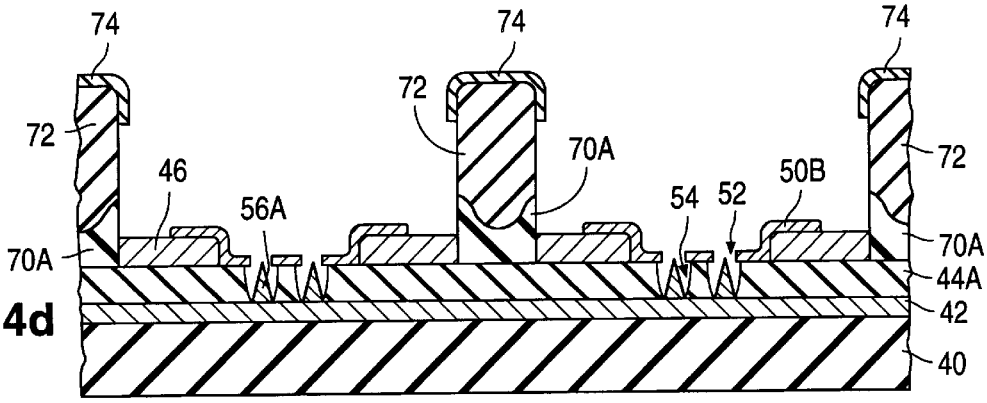
Figure 5:
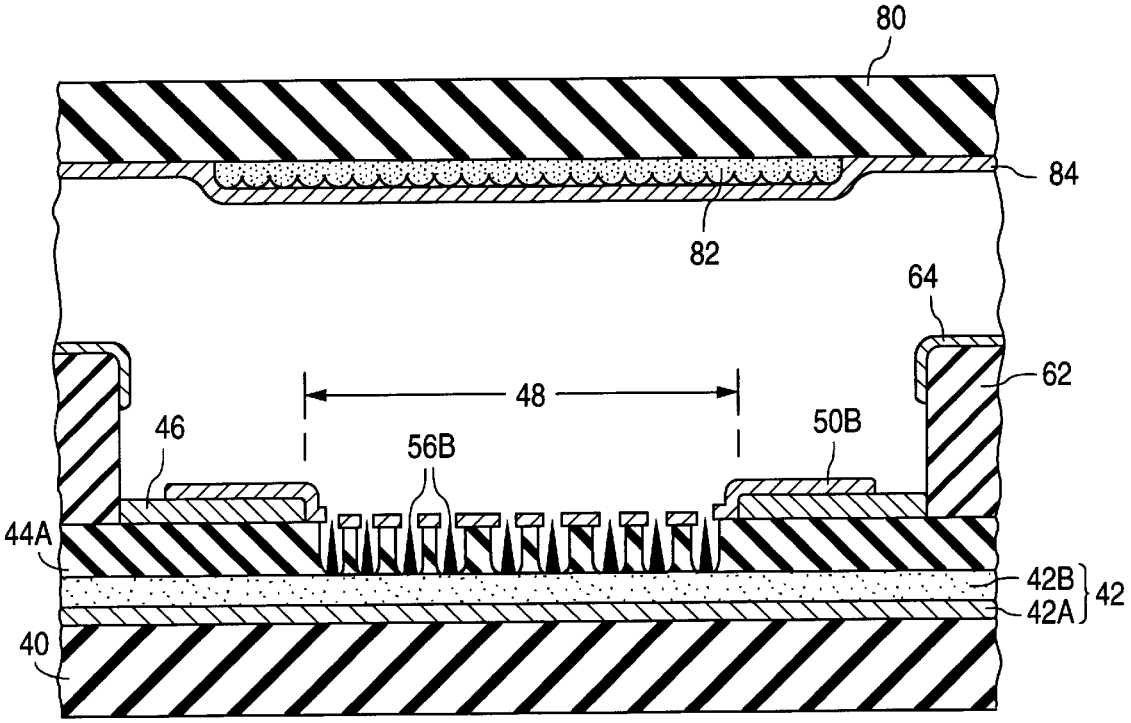
FIG. 5 is a cross-sectional structural view of a flat-panel CRT display that includes a gated field emitter fabricated in accordance with the invention.

FIG. 5 depicts a typical example of the core active region of a flat-panel CRT display that employs an area field emitter, such as that of FIG. 2*g* or 4*d*, manufactured according to the invention. In representing the core of a flat-panel CRT display that contains the field emitter of FIG. 4*d*, component 62 in FIG. 5 is replaced with components 70A and 72, while component 64 is replaced with component 74. Lower non-insulating region 42 here consists specifically of emitter electrodes 42A and an overlying electrically resistive layer 42B. One main control electrode 46 is depicted in FIG. 5.

A transparent, typically glass, largely flat faceplate 80 is located across from baseplate 40. Light-emitting phosphor regions 82, one of which is shown in FIG. 5, are situated on the interior surface of faceplate 80 directly across from corresponding control apertures 48. A thin light-reflective layer 84, typically aluminum, overlies phosphor regions 82 along the interior surface of faceplate 80. Electrons emitted by electron-emissive elements 56A pass through light-reflective layer 84 and cause phosphor regions 82 to emit light that produces an image visible on the exterior surface of faceplate 80.

The core active region of the flat-panel CRT display typically includes other components not shown in FIG. 5. For example, a black matrix situated along the interior surface of faceplate 80 typically surrounds each phosphor region 82 to laterally separate it from other phosphor regions 82. Spacer walls are utilized to maintain a relatively constant spacing between plates 40 and 80.

When incorporated into a flat-panel CRT display of the type illustrated in FIG. 5, a field emitter manufactured according to the invention operates in the following way. Light-reflective layer 84 serves as an anode for the field-emission cathode. The anode is maintained at high positive potential relative to the composite control electrodes 46/50B and emitter electrodes 42A.

When a suitable potential is applied between (a) a selected one of emitter electrodes 42A and (b) a selected one of control electrodes 46/50B, the so-selected gate portion 50B extracts electrons from the electron-emissive elements at the intersection of the two selected electrodes and controls the magnitude of the resulting electron current. Upon being hit by the extracted electrons, phosphor regions 82 emit light.

Directional terms such as "lower" and "upper" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, features other than portions of an electron focusing system can be formed over the partially finished field emitter after patterning excess emitter-material layer 56B to form islands 56C but before removing islands 56C. Techniques other than lift-off and electrochemical removal can be utilized to remove islands 56C.

The masked etch of blanket excess emitter-material layer 56B can be performed in such a way that substantially all, rather than just part, of each main control electrode 46 is covered with excess emitter material, all of the excess emitter material being removed from the areas between control electrodes 46. The electrochemical removal procedure of the invention can be performed long enough to create openings through patterned excess-emitter material islands 56C for exposing electron-emissive cones 56A but not long enough to entirety remove islands 56C. By combining these two variations, the remaining excess emitter material situated on composite control electrodes 46/50B can serve as parts of electrodes 46/50B to increase their current-conduction capability.

Techniques other than a masked etch can be employed in patterning excess emitter-material layer 56B to form islands 56C in the process sequence of FIG. 4. For instance, before depositing the emitter material to create cones 56A and excess layer 56B, portions of a readily removable material such as photoresist can be provided over the areas of the field emitter where the portions of excess layer 56B are to be removed in defining islands 56C. After depositing the emitter material, the readily removable material is removed to remove (i.e., lift off) the overlying portion of layer 56B, thereby leaving islands 56C.

Gate layer 50A can be patterned to form gate portions 50B before depositing the emitter cone material to create electron-emissive elements 56A and excess emitter-material layer 56B, and typically also before creating dielectric openings 54. The combination of each main control electrode 46 and the adjoining gate portions 50B then forms a composite control electrode 46/50B prior to depositing the emitter material.

Main control electrodes 46 can be formed after depositing gate layer 50. In that case, control electrodes 46 overlie, rather than underlie, gate portions 50B. Also, each main control electrode 46 and adjoining gate portions 50B can be replaced with a single-layer gate electrode have gate openings but no openings analogous to control apertures 48.

The processes of FIGS. 2 and 4 can be revised to make electron-emissive elements of non-conical shape. As an example, deposition of the emitter material can be terminated before fully closing the openings through which the emitter material enters dielectric openings 54. Electron-emissive elements 56A are then formed generally in the shape of truncated cones.

The electron emitters produced according to the invention can be employed in flat-panel devices other than flat-panel CRT displays. Various modifications and applications may thus be made by those skilled in the art without departing from the true scope and spirit of the invention as defined in the appended claims.

I claim:

1. A method comprising the steps of:

providing an initial structure in which a group of control electrodes overlie a dielectric layer, a multiplicity of electron-emissive elements comprising electrically non-insulating emitter material are situated largely in dielectric openings extending through the dielectric layer and are exposed through control apertures extending through the control electrodes, and an excess layer comprising the emitter material overlies the control electrodes;

furnishing a protective layer over the excess layer above at least the electron-emissive elements;

subsequently performing at least one processing operation on the initial structure; and subsequently removing material of the excess and protective layers overlying the control electrodes above the electron-emissive elements so as to expose the electron-emissive elements.

2. A method as in claim 1 wherein the protective layer is largely impervious to materials to which the initial structure is subjected during the performing step.

3. A method as in claim 1 wherein the providing step includes configuring the initial structure so that the excess layer also overlies portions of the dielectric layer in spaces between the control electrodes.

4. A method as in claim 3 wherein the furnishing step entails forming the protective layer to overlie the excess layer above the dielectric layer in the spaces between the control electrodes, the method further including, between the furnishing and performing steps, the step of initially removing portions of the protective and excess layers overlying the dielectric layer in the spaces between the control electrodes.

5. A method as in claim 4 wherein the subsequently removing step entails electrochemically removing emitter material of the excess layer overlying the control electrodes above the electron-emissive elements.

6. A method as in claim 4 wherein:

the providing step includes providing the initial structure with a lift-off layer situated at least between (a) the control electrodes and (b) emitter material of the excess layer overlying the control electrodes; and the subsequently removing step entails removing the lift-off layer so as to at least remove material of the excess layer overlying the control electrodes.

7. A method as in claim 4 wherein the performing step comprises forming at least part of at least one additional feature over the dielectric layer in the spaces between the control electrodes.

8. A method as in claim 4 wherein the performing step comprises forming part of a focusing system over the dielectric layer in the spaces between the control electrodes.

9. A method as in claim 3 further including, between the providing and furnishing steps, the step of initially removing portions of the excess layer overlying the dielectric layer in the spaces between the control electrodes.

10. A method as in claim 9 wherein the furnishing step entails forming the protective layer to overlie the dielectric layer in the spaces between the control electrodes.

11. A method as in claim 10 wherein the removing step comprises:

removing vertically exposed material of the protective layer overlying the control electrodes above the electron-emissive elements; and electrochemically removing emitter material of the excess layer overlying the control electrodes above the electron-emissive elements.

12. A method as in claim 10 wherein:

the providing step includes providing the initial structure with a lift-off layer situated at least between (a) the control electrodes and (b) emitter material of the excess layer overlying the control electrodes; and the removing step entails removing the lift-off layer so as to at least remove material of the excess layer overlying the control electrodes.

13. A method as in claim 10 wherein the performing step comprising forming at least part of at least one additional feature over the protective layer in the spaces between the control electrodes.

14. A method as in claim 10 wherein the performing step comprises forming part of a focusing system over the protective layer in the spaces between the control electrodes.

15. A method as in claim 10 wherein the protective layer comprises electrically non-conductive material.

16. A method as in claim 1 wherein the providing step entails depositing the emitter material (a) through the control apertures into the dielectric openings to at least partially form the electron-emissive elements and (b) over the control electrodes and over the dielectric layer in spaces between the control electrodes to at least partially form the excess layer.

17. A method as in claim 1 wherein:

the providing step entails providing the initial structure with an electrically non-insulating gate layer adjoining the control electrodes, extending into spaces between the control electrodes, and underlying the excess layer;

each electron-emissive element is exposed through a gate opening extending through the gate layer; and the dielectric openings are allocated into a plurality of laterally separated sets of the dielectric openings, each control aperture located above a different one of the sets of dielectric openings.

18. A method as in claim 17 wherein the gate layer substantially fully laterally spans each control aperture.

19. A method as in claim 17 wherein, prior to the furnishing step, the gate layer is largely a blanket layer except for the gate openings.

20. A method as in claim 17 further including, between the providing and performing steps, the step of removing portions of the gate layer overlying the dielectric layer in the spaces between the control electrodes, each control electrode and remaining adjoining material of the gate layer forming at least part of a composite control electrode.

21. A method as in claim 1 wherein:

each control electrode comprises a main control electrode and at least one adjoining gate portion;

each control aperture is a composite control aperture comprising (a) a main control aperture extending through one of the control electrodes and (b) at least one gate opening extending through an adjoining one of the gate portions; and the dielectric openings are allocated into a plurality of laterally separated sets of the dielectric openings, each main control aperture located above a different one of the sets of dielectric openings.

22. A method as in claim 21 wherein the gate portions substantially fully laterally span the main control apertures.

23. A method as in claim 21 wherein there are a like plurality of gate portions, each substantially fully laterally spanning a different one of the main control apertures.

24. A method as in claim 1 wherein the providing step includes providing the initial structure with a lower electrically non-insulating region that underlies the dielectric layer and the electron-emissive elements.

* * * * *